US005523523A

United States Patent [19]

Chen

[11] Patent Number: 5,523,523

[45] **Date of Patent: *Jun. 4, 1996**

[54] MUSICAL BOX

[76] Inventor: Joseph Chen, P.O. Box 82-144, Taipei, Taiwan

[ * ] Notice: The term of this patent shall not extend beyond the expiration date of Pat. No. 5,331,110.

[21] Appl. No.: 502,760

[22] Filed: Jul. 14, 1995

[51] Int. Cl.[6] ..... G10F 1/06; A63H 3/28

[52] U.S. Cl. ..... 84/95.2; 446/298; D17/24

[58] Field of Search ..... 84/95.1, 95.2, 84/94.1, 94.2; 446/280, 281, 282, 298, 303, 236, 297; D17/24; 40/411, 415

[56] References Cited

U.S. PATENT DOCUMENTS 5,331,110 7/1994 Chen ..... 84/95.2

*Primary Examiner*—Cassandra C. Spyrou

*Attorney, Agent, or Firm*—Alfred Lei

[57] ABSTRACT

A musical box including a base, a seat having a casing, a spiral spring fitted within the casing, a control lever connected to the spring, a drum having a first end and a second end, a gear fixedly mounted on the first end of the drum, a gear train connected to the spring and engaging the gear, a hitting member fixedly mounted on the seat and having a plurality of tines in contact with the drum, a disc fixedly connected to the second end of the drum and being provided with an eccentric pin, a frame having a first leg and a second leg, a second gear meshed with the gear, an axle extending downward and vertically through the frame and engaging the second gear, an arm sleeved over the axle and connected to the hole of the disc, a guide member fixedly mounted on the arm and having an elongated slot adapted to receive the eccentric pin of the disc, a connector attached to the axle, and a sleeve fitted over the axle, whereby a doll can be moved upward and downward alternately by the guide member and rotated by the axle.

1 Claim, 4 Drawing Sheets

MUSICAL BOX

CROSS-REFERENCE

Related application Ser. No. 08/136,321, filed Oct. 13, 1993, now granted U.S. Pat. No. 5,331,110 is acknowledged.

BACKGROUND OF THE INVENTION

1. Field of the Invention

This invention relates to an improved musical box.

2. Description of the Prior Art

It is found that the conventional musical box is simply a box with a mechanical device that produces a tune when the box is opened. However, such a musical box is monotonous and too complicated in structure thereby increasing the cost thereof.

Therefore, it is an object of the present invention to provide musical box which may obviate and mitigate the above-mentioned drawbacks.

SUMMARY OF THE INVENTION

This invention relates to a musical box.

It is the primary object of the present invention to provide a musical box which will cause a doll to go up and down smoothly when producing music.

It is another object of the present invention to provide a musical box which is simple in construction.

It is still another object of the present invention to provide a musical box which is compact in size.

It is still another object of the present invention to provide a musical box which is economic to manufacture.

It is a further object of the present invention to provide a musical box which is amusing and interesting.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
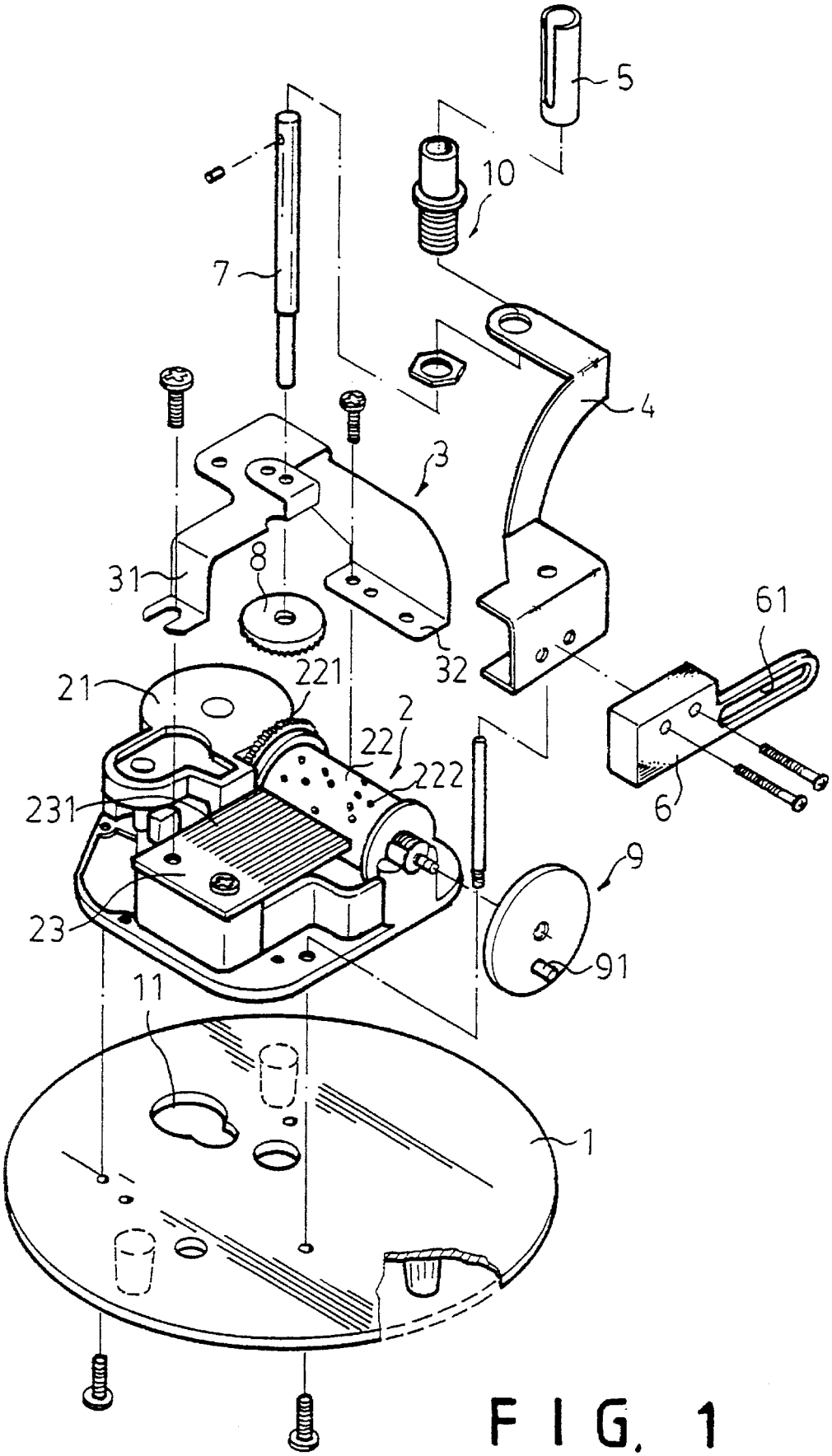
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
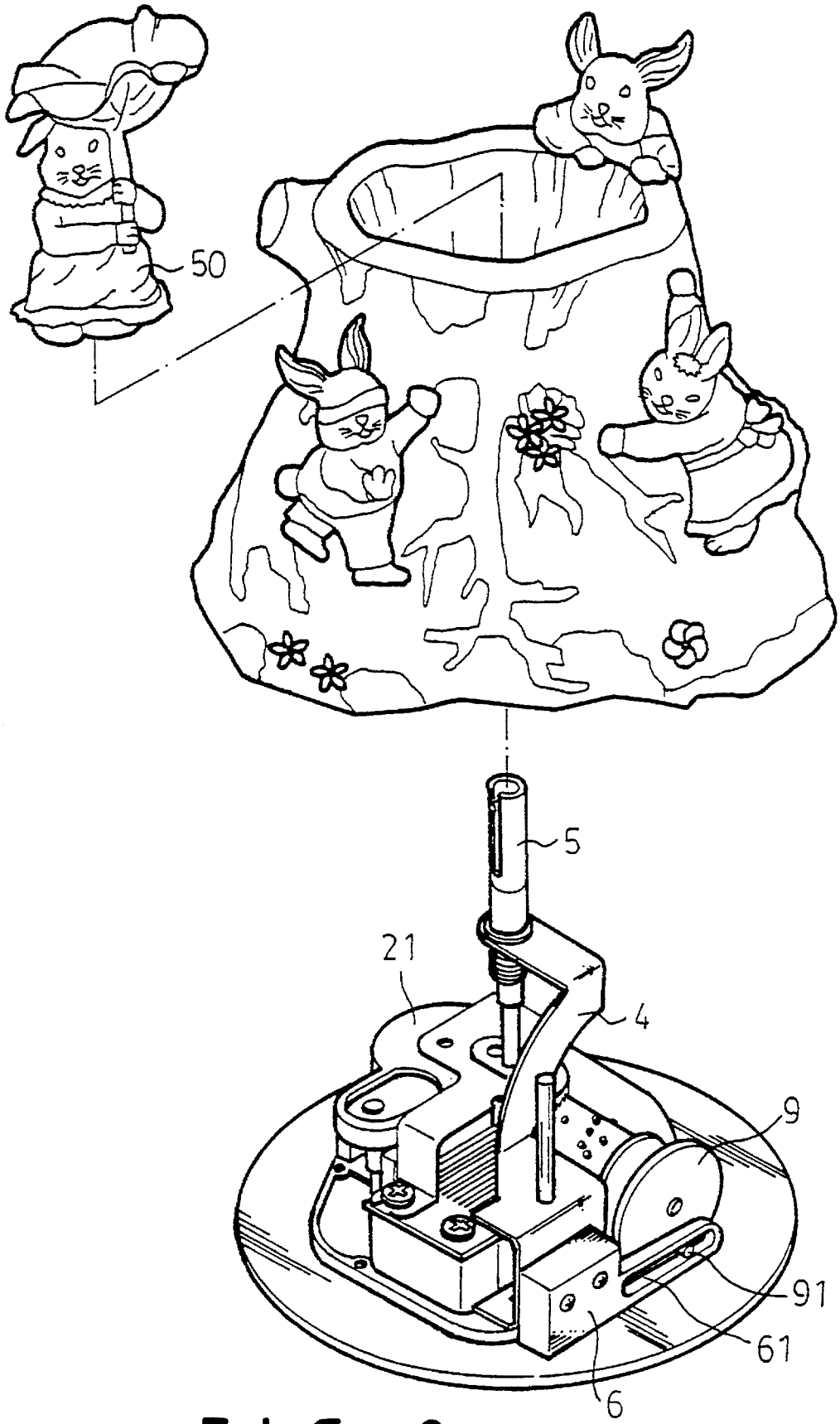
FIG. 2 is a perspective view of the present invention.

With reference to the drawings and in particular to FIGS. 1 and 2 thereof, the musical box according to the present invention mainly comprises a base 1, a seat 2, a frame 3, an arm 4, a sleeve 5, a guide block 6, a disc 9 and a connector 10.

Figure 4:
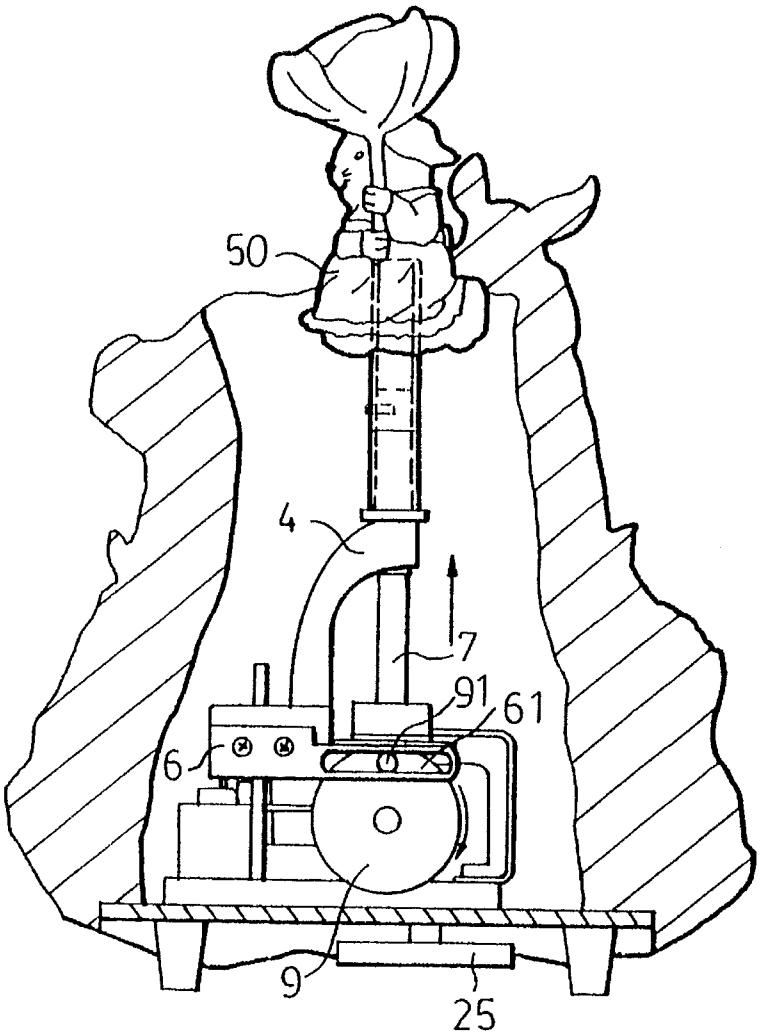
FIG. 3, 4, 5 and 6 show the working principle of the present invention.
Figure 3:
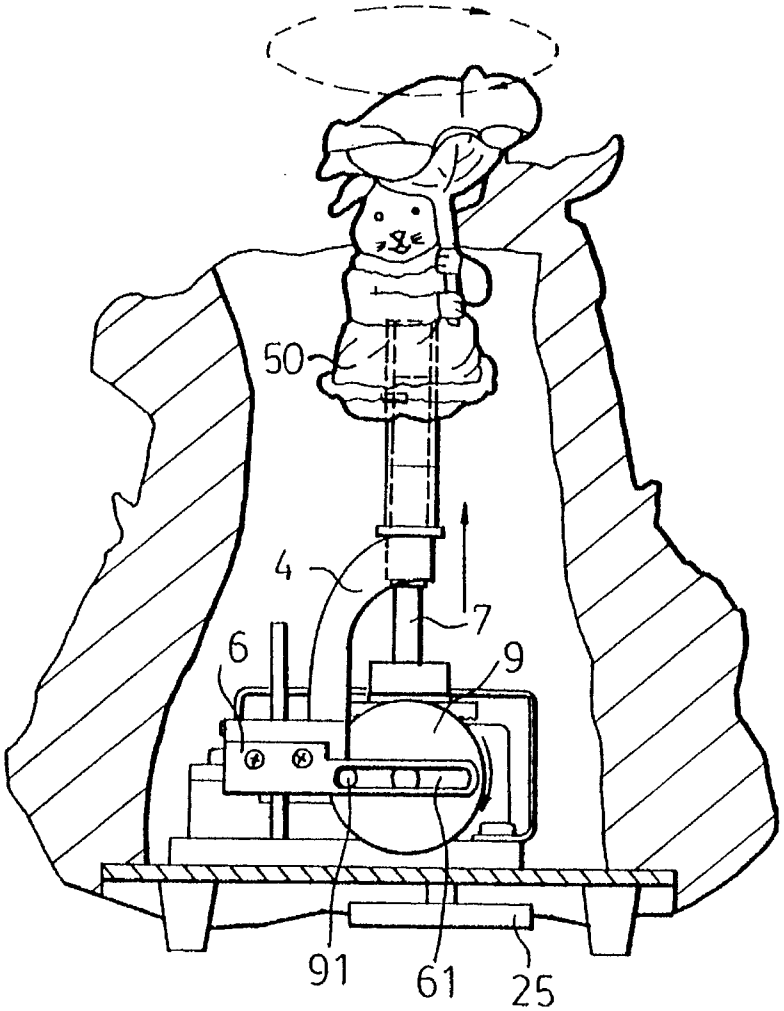
Figure 6:
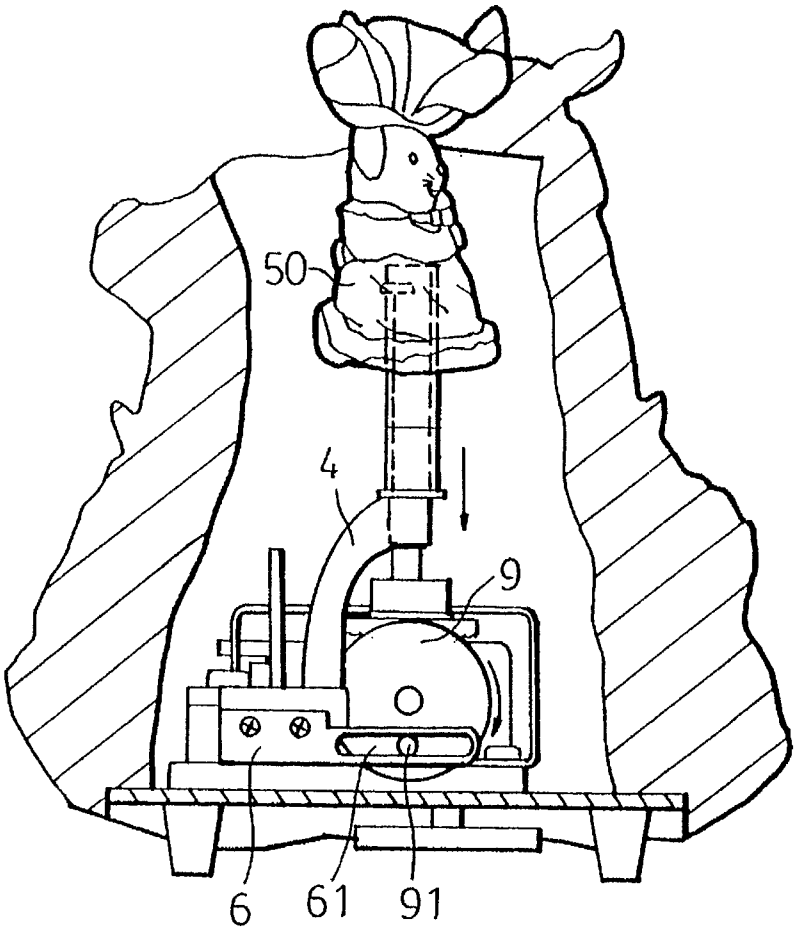
Figure 5:
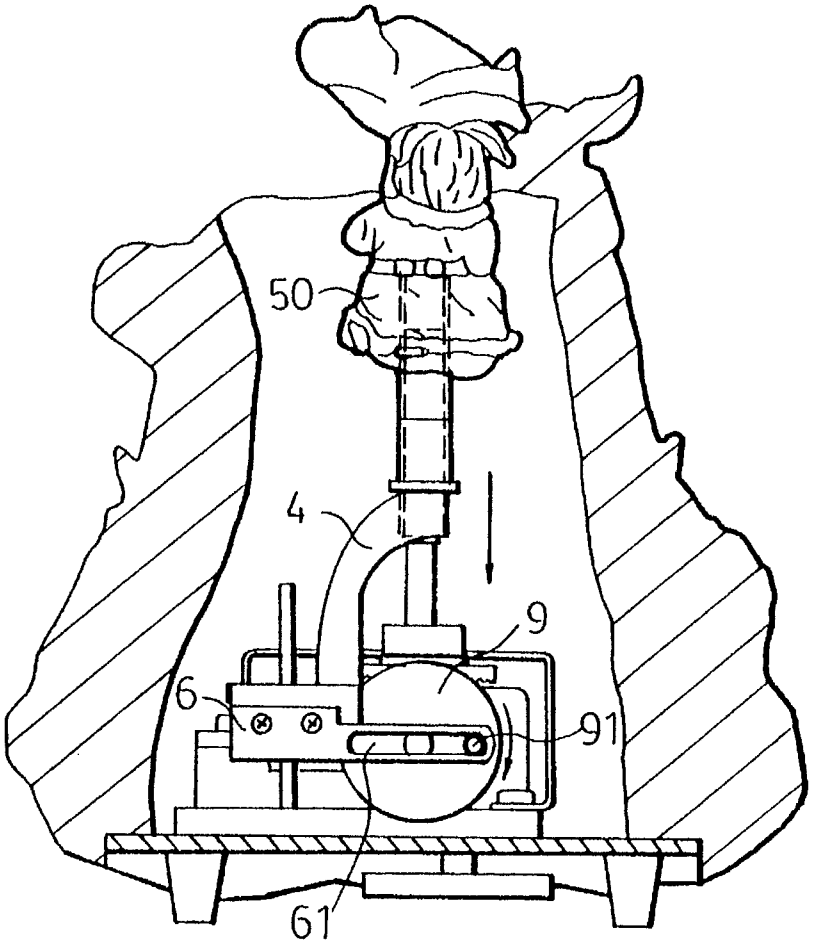

As illustrated, the seat 2 is fixedly mounted on the base 1 by screws (not shown). On the seat 2 are mounted a casing 21 in which is fitted a spiral spring (not shown). The spiral spring is connected with a control lever 25 (see FIGS. 3 and 4) by means of which the spiral spring can be turned tight. The spiral spring is connected with a gear train (not shown) so that the spiral spring will drive the gear train to rotate. The gear train is in turn engaged with a gear 221 which is fixedly mounted on one end of a drum 22 formed with a plurality of protuberances 222 thereon. A hitting member 23 having a plurality of tines 231 is fixedly mounted on the seat 2, with its tines 231 contacting the surface of the drum 22. A disc 9 is connected with the other end of the drum 22 and is provided with an eccentric pin 91.

The frame 3 is provided with a first leg 31 fixedly mounted on the hitting member 23 and a second leg 32 fixedly mounted on the seat 2. The axle 7 extends downwardly and vertically through the frame 3 to engage with a gear 8 which is meshed with the gear 221 fixedly mounted on one end of the drum 22. The arm 4 is sleeved over the axle 7 and fixedly connected with the guide block 6. The guide block 6 is formed with an elongated slot 61 adapted to receive the eccentric pin 91 of the disc 9. The connector 10 is put on to the axle 7 and supported by the arm 4. The sleeve 5 is put on to the axle 7 and disposed on the connector 10. A doll 50 is fixedly mounted on the upper end of the axle 7 and disposed above the sleeve 5.

Referring to FIGS. 3, 4, 5 and 6, there are shown the working principle of the present invention. When desired to produce music, simply turn the control lever 25 to turn the spiral spring tight and release the control lever 25. Then, the spiral spring will drive the gear train which will in turn drive the gear 221 thereby rotating the drum 22 and the disc 9. As the drum 22 is rotated, the tines 231 of the hitting member 23 will hit the protuberances 222 of the drum 22 hence producing music. In the meantime, the gear 221 will rotate the gear 8 thus rotating the axle 7. When the disc 9 is rotated, the eccentric pin 91 will move the guide block 6 together with the arm 4 to go upward and downward alternately. Hence, the doll 50 will be moved upward and downward alternately by the guide block 6 and rotated by the axle 7.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A musical box comprising:

a base;

a seat having a casing; said seat fixedly mounted on said base;

a spiral spring fitted within said casing;

a control lever connected to said spring;

a drum having a first end and a second end; said drum including a plurality of protuberances thereon;

a gear fixedly mounted on said first end of said drum;

a gear train connected to said spring and engaging said gear;

a hitting member fixedly mounted on said seat and having a plurality of tines in contact with said drum;

a disc fixedly connected to said second end of said drum and being provided with an eccentric pin;

a frame having a first leg and a second leg; said first leg connected to said hitting member and said second leg connected to said seat;

a second gear meshed with said gear;

an axle extending downward and vertically through said frame and engaging said second gear;

an arm having an end sleeved over said axle;

a guide member fixedly mounted on another end of said arm and having an elongated slot adapted to receive said eccentric pin of said disc;

a connector attached to said axle; and a sleeve fitted over said axle.

* * * * *